United States Patent [19]

Waters et al.

[11] Patent Number: 4,802,553

[45] Date of Patent: Feb. 7, 1989

[54] ALUMINUM SCAFFOLD PLANK

[75] Inventors: Herman H. Waters; John White, both of Magnolia, Ark.

[73] Assignee: Alumax, Inc., San Mateo, Calif.

[21] Appl. No.: 63,572

[22] Filed: Jun. 16, 1987

[51] Int. Cl.[4] ..... E04G 5/08

[52] U.S. Cl. ..... 182/222; 182/179

[58] Field of Search ..... 182/222, 223, 119, 179

[56] References Cited

U.S. PATENT DOCUMENTS

| | | | |
|---|---|---|---|
| 2,261,831 | 11/1941 | Farr | 182/223 |
| 2,485,165 | 10/1949 | Pollman | 182/223 |
| 2,851,311 | 9/1958 | Gibbs | 182/222 |
| 2,981,365 | 4/1961 | Olsen | 182/223 |
| 4,561,165 | 12/1985 | Bayer | 182/119 |
| 4,598,794 | 7/1986 | Anderson | 182/119 |

*Primary Examiner*—Reinaldo P. Machado

*Attorney, Agent, or Firm*—Limbach, Limbach & Sutton

[57] ABSTRACT

A scaffolding plank is disclosed without interjacent gaps for use with a scaffolding frame. The scaffolding plank includes a support platform, a means for attaching said support platform to a horizontal bar of the scaffolding frame and a tongue member extending from an end of said platform and covering nearly one half of said bar. The tongue member is positioned so as not to interfere with the means for attaching.

7 Claims, 1 Drawing Sheet

ALUMINUM SCAFFOLD PLANK

FIELD OF THE INVENTION

This invention relates to the field of scaffolding planks. More particularly, this invention relates to a self-contained scaffolding plank module configured so to obviate inter-plank gaps.

BACKGROUND OF THE INVENTION

Scaffold planks having grasper hooks available in a variety of configurations for attaching the plank to a scaffolding frame are well known in the art. The conventional scaffolding plank utilizing grasper hooks conforms to an elongated rectangular shape. The grasper hooks extend beyond the end of the scaffolding plank so as not to interfere with the attaching of an adjoining plank module. In forming a catwalk or other structure from scaffolding planks, a scaffolding frame is constructed with appropriate spacing to receive scaffolding planks where needed for the particular purpose. The scaffolding planks are positioned in a row to form a catwalk path for workmen. The grasper hooks are positioned to rest on scaffolding frame crossbars. Should the scaffolding plank extend further than the grasper hook without sufficient clearance for the adjoining plank grasper hook, each plank would interfere with the assemblage of the adjoining plank grasper hook.

By recessing the distal end of the plank from the end of the grasper hook by a sufficient amount to prevent interference with the adjoining plank, a gap is left in the catwalk planking at each scaffolding frame crossbar. Such gaps are inconvenient and dangerous. Objects such as tools, paint or welding sparks may pass through the gaps injuring persons or equipment below.

In order to eliminate the gap in such scaffolding, workmen have placed boards or other objects on the scaffold over the gaps. While such a practice does close the gap, it creates another safety hazard. The workmen can trip on the object used to cover the gap thereby injuring himself or fall off the scaffolding. Also, in tripping over such a gap covering object, the workmen may kick that object off the scaffolding and injure a person or equipment below. It is an object of the present invention to provide an improved scaffolding plank having grasper hooks which forms minimum gaps between adjoining scaffolding planks.

It is another object of the present invention to provide a scaffold plank which does not interfere in the assemblage of an adjoining scaffold plank.

Figure 1:
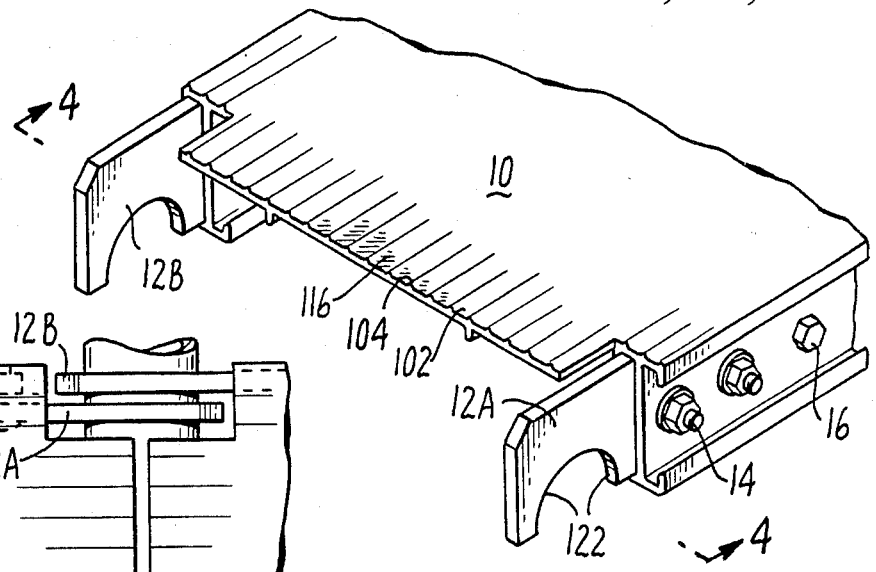
FIG. 1 shows a perspective view of one end of a scaffold plank of a preferred embodiment of the present invention.

Certain elements shown in the drawing appear more than once in a given embodiment. Where necessary for clarity, an alphabetic postscript will be used to differentiate between the several similar elements, for example 106A and 106B. Where a portion of the description refers to all such elements no postscript will be used.

DETAILED DESCRIPTION OF THE PRESENT INVENTION

Figure 2:
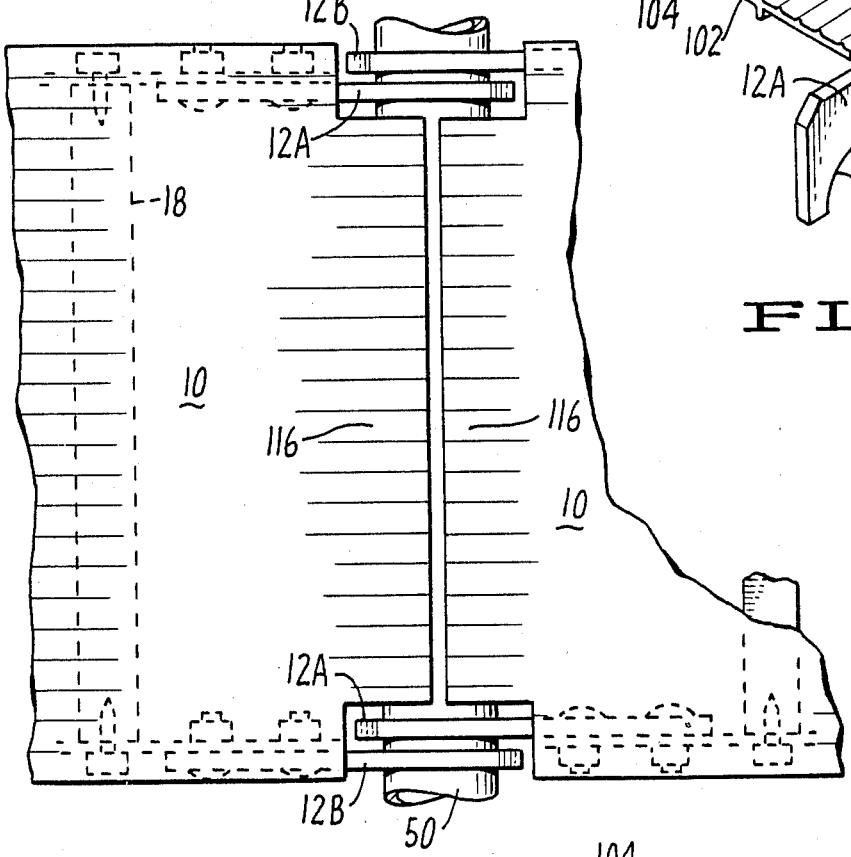
FIG. 2 shows a top view of the end of the two adjoining scaffold planks of the present invention attached to scaffolding frame crossbar.
Figure 3:
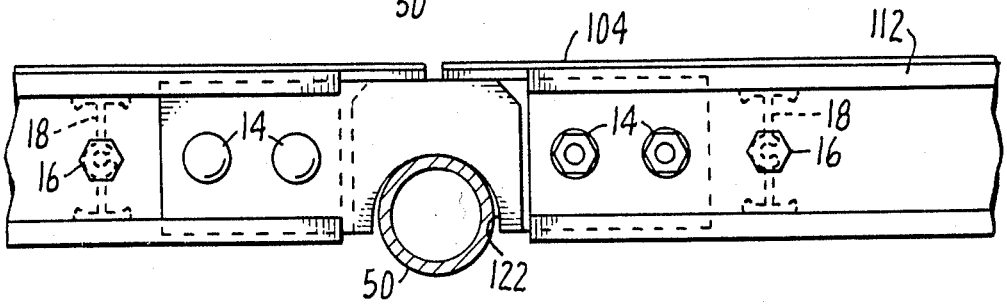
FIG. 3 shows a side view of the end of the two adjoining scaffold planks of the present invention attached to a scaffolding frame crossbar.

Referring to FIG. 1, the preferred embodiment of the present invention is constructed of a platform member 10, grasper hooks 12A and 12B and fasteners 14 and 16. A platform support member 18 is shown in FIGS. 2, 3 and 4.

Figure 4:
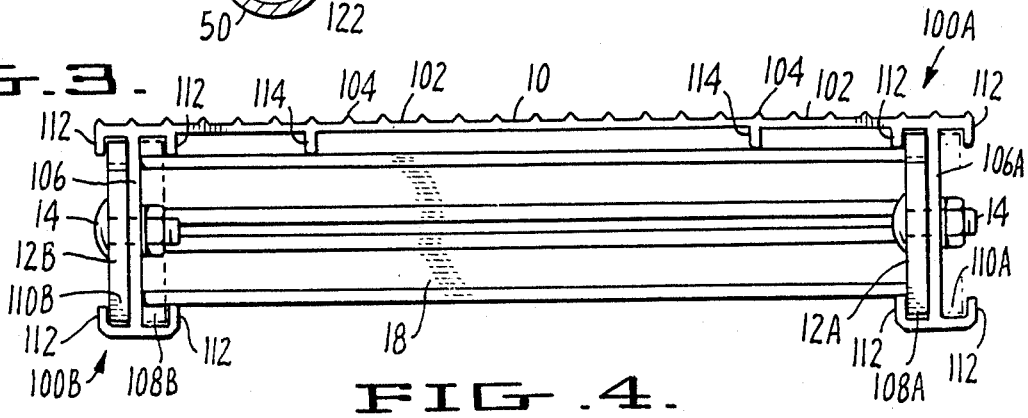
FIG. 4 shows a cross-section end view of the preferred embodiment of the present invention.

The construction of the platform member 10 is most clearly seen with reference to the cross-section of FIG. 4. The platform member 10 consists primarily of a broad platform surface 102 for supporting persons and equipment. Ridges 104 are formed in the top surface of platform 104 in order to enhance the surface friction of the platform. Vertical support members 106A and 106B are formed near the edges 100A and 100B respectively of the platform member 10 and extend from the bottom surface of platform member 10. An inner "C"-shaped slotted region 108A and 108B and an outer "C"-shaped slotted region 110A and 110B are formed on the inner and outer surfaces, respectively, of the vertical support members 106A and 106B. The inner slots and outer slots are formed to be the same size and dimensions. The slots are formed by flanges 112 which are parallel to and spaced apart from each of the vertical support member 106. Each vertical support member 106 and flanges 112 run the length of the platform member 10. Support flanges 114 extend from the bottom surface of the support surface 102. The support flanges extend a similar distance from the bottom surface of support member 10 as the flanges 112. Support flanges 114 are formed the length of platform member 10. Platform member 10 is preferably formed by extruding aluminum or an aluminum alloy through an appropriately formed die.

At each corner of platform member 10, the platform surface 102 is shaped by cutting out and removing a portion of the platform surface 102, each vertical support 106 and each flange 112 to form a tongue 116. The tongue 116 extends beyond the length of each vertical support 106.

The grasper hooks 12A and 12B are preferably formed of aluminum with an end cross-section of an appropriate size to be easily accepted into and substantially fill the inner slots 108 and outer slots 110. The scaffold is assembled by inserting a pair of grasper hooks 12A and 12B into slots 108 or 110 at each end of platform 10.

Preferably, the grasper hooks 12A and 12B are positioned into the inner slot 108 of one vertical support member 106 and the outer slot 110 of the opposite vertical member 106 at one end of the platform 10. In other words, grasper hook 12A would be positioned into inner slot 108A and grasper hook 12B into outer slot 110B. The grasper hooks at the opposite end of the platform 10 are positioned in the opposite pair of slots. The outer slot 110A at one end of platform member 10 is the outer slot 110B at the opposite end of platform member 10. The scaffold planks are non-directional. In other words, the scaffold is properly attached to a given scaffold frame horizontal support bar 50 regardless of which end of the platform 10 is attached. Referring to FIG. 2, two scaffold planks assembled as described above are shown with the gripper members 12A and 12B resting on a scaffold frame horizontal support bar 50. If either or both scaffold planks were turned around so that the opposite end of the platform member 10 were coupled to the same bar 50, the configuration would be the same.

A semi-circle 122 is cut from one edge of each grasper hook 12. The semi-circle 122 cut into an edge of the grasper hook must point down and should be positioned beyond the end of each vertical support 106. This is performed at each end of platform 10. Holes are drilled through each vertical support member 106A and 106B and also through each grasper hook 12A and 12B so as to receive the fasteners I4. Preferably, each grasper hook 12 is attached to a vertical support member 106 by a pair of round head machine screws, lock washers and nuts. It is important that the grasper hooks 12A and 12B be so positioned within their respective slots 108 or 110 that the semi-circles cut into the grasper hooks 12A and 12B are evenly positioned relative to a line perpendicular to the length of platform 10. In this way, the semi-circles 122 of gripper member 12A and gripper member 12B may be made to rest on a horizontal support bar 50 of a scaffold frame not shown.

The tongue 116 of each plank is formed by cutting out of each corner of the platform member 10 and removing a portion of each vertical support member 106 and a portion of each flange 112. In this way, a portion of the grasper hooks 12A and 12B are exposed. The tongue 116 extends almost but not quite to the center of the semi-circle 122 of each grasper hook 12A and 12B. Because of this configuration, the tongues 116 of two adjoining scaffolding planks will almost meet directly above the center of the horizontal scaffolding frame bar 50. In so doing, the gap which ordinarily occurs in typical prior art scaffolding is virtually eliminated. The very narrow gap remaining between adjoining tongues 116 would typically be on the order of approximately ¼ inch. This gap is left to account for manufacturing tolerances and to prevent adjoining scaffolding planks from interfering with one another. Further, because the ground surface on which a scaffold is built may not be perfectly level, some gap is needed to account for the scaffolding planks meeting so as to form an other than perfectly parallel surface. Support member 18 is an "I" shaped bar of an appropriate height to fit between an upper and lower flange 112. Flanges 114 being constructed of a similar length as flanges 112 will also rest on support bar 18. The cross-section of support bar 18 as shown in FIG. 3 preferably has a "C"-shaped center. A self-tapping screw 16 will pass through a hole formed through each vertical support member 106 and tap into the "C"-shaped cross-section of support member 18. These may be positioned as needed for support anywhere along the length of scaffolding plank 10.

An improved scaffolding plank is disclosed which virtually eliminates inter-plank gaps. A scaffold assembled from such planks is safer because there is no gap for objects to fall through.

What is claimed is:

1. A scaffolding plank without interjacent gaps for use with a scaffolding frame comprising:

a. a support platform having a first end, a second end, a top surface and a bottom surface;

b. a plurality of grasper hooks, each of said hooks having a scaffolding frame receiving aperture, certain of said hooks affixed to said first end and a remainder of said hooks affixed to said second end, a portion of each of said hooks extending beyond said first end and said second end;

c. a first tongue member extending from said first end and a second tongue member extending from said second end, each of said tongue members being positioned so as not to interfere with said hooks, said tongue members extending nearly to a center of said aperture;

d. vertical support members positioned on said bottom surface and further wherein each of said vertical support members extends along the length of the bottom surface and further comprises an I-beam having a vertical web and horizontal upper and lower flanges attached to the web, and wherein the flanges are bent over to form slots for receiving an end of one of the grapser hooks, said slots being dimensioned so as to be substantially filled by the end of the grasper hook.

2. The scaffolding plank according to claim 1 wherein said support platform is formed of aluminum.

3. The scaffolding plank according to claim 2 wherein said hooks are formed of aluminum.

4. The scaffolding plank according to claim 1 wherein said aperture is formed through a lower edge of said hook in a semi-circular shape.

5. A scaffolding plank for use with a scaffolding frame without interjacent gaps comprising:

a. a primarily rectangular, extruded support platform having:

(1) a first end and a second end;

(2) a first side edge and a second side edge;

(3) a top surface and a bottom surface;

(4) a pair of I-beam support members attached to and extending the length of said bottom surface; and (5) ridges formed on said top surface parallel to said edges;

b. four grasper hooks, each of said grasper hooks having a semi-circle aperture formed in one edge to receive a horizontal bar of said scaffolding frame, each of said grasper hooks being affixed to a separate end of said vertical support members, said grasper hooks extending beyond said first end and said second end; and c. a tongue member, positioned at said first end and said second end, formed out of said support platform, each of said tongue members positioned between and spaced apart from said grapser hooks so as not to interfere with them, said tongue member extending nearly to a center of said aperture.

6. The scaffolding plank according to claims 1 or wherein each scaffolding plank includes a pair of parallel I-beam supports, each of which has an outside surface, facing away from the other I-beam, and an inside surface, facing the other I-beam of the pair, and further wherein at each end of the platform, one of the grasper hooks is attached to one of the I-beam supports one of the I-beam supports on its outside surface and one of the grasper hooks is attached to the other I-beam of the pair on its inside surface.

7. The scaffolding plank according to claim 6 wherein the grasper hooks are similarly attached to the I-beam ends at diagonally opposite ends of each support platform whereby two support platforms can be attached end to end to said scaffolding frame without interference between the grasper hooks of each scaffolding plank.

* * * * *